US009172188B2

(12) United States Patent
Sticker et al.

(10) Patent No.: US 9,172,188 B2
(45) Date of Patent: Oct. 27, 2015

(54) PLUG FOR A DATA AND/OR TELECOMMUNICATION CABLE COMPRISING SEVERAL CONDUCTORS

(71) Applicant: MCQ TECH GmbH, Blumberg (DE)

(72) Inventors: Rolf Sticker, Donaueschingen (DE); Eduard Betz, Bonndorf (DE)

(73) Assignee: MCQ TECH GMBH, Blumberg (DE)

( * ) Notice: Subject to any disclaimer, the term of this patent is extended or adjusted under 35 U.S.C. 154(b) by 3 days.

(21) Appl. No.: 14/183,697

(22) Filed: Feb. 19, 2014

(65) Prior Publication Data

US 2014/0315420 A1 Oct. 23, 2014

(30) Foreign Application Priority Data

Apr. 22, 2013 (DE) ..... 10 2013 207 234

(51) Int. Cl.

| | |
|---|---|
| ***H01R 4/24*** | (2006.01) |
| ***H01R 13/64*** | (2006.01) |
| ***H01R 13/50*** | (2006.01) |
| ***H01R 13/506*** | (2006.01) |
| ***H01R 43/16*** | (2006.01) |
| *H01R 13/58* | (2006.01) |
| *H01R 24/64* | (2011.01) |
| *H01R 107/00* | (2006.01) |
| *H01R 13/6461* | (2011.01) |

(52) U.S. Cl.

CPC ..... *H01R 13/64* (2013.01); *H01R 13/501* (2013.01); *H01R 13/506* (2013.01); *H01R 43/16* (2013.01); *H01R 13/5829* (2013.01); *H01R 13/6461* (2013.01); *H01R 24/64* (2013.01); *H01R 2107/00* (2013.01); *Y10T 29/49208* (2013.01)

(58) Field of Classification Search

CPC ..... H01R 13/5829
USPC ..... 439/418, 456, 459, 460, 467
See application file for complete search history.

(56) References Cited

U.S. PATENT DOCUMENTS

| | | | | |
|---|---|---|---|---|
| 4,516,822 | A | 5/1985 | Wolfel | |
| 6,406,325 | B1 * | 6/2002 | Chen | 439/418 |
| 6,439,920 | B1 * | 8/2002 | Chen | 439/418 |
| 6,837,738 | B1 * | 1/2005 | Chen | 439/418 |
| 7,175,468 | B1 | 2/2007 | Chang | |
| 7,972,150 | B1 | 7/2011 | Lin | |
| 8,702,444 | B2 * | 4/2014 | Maranto et al. | 439/467 |
| 8,845,359 | B2 * | 9/2014 | Taylor et al. | 439/447 |
| 2005/0186835 | A1 | 8/2005 | Liao | |
| 2012/0094525 | A1 | 4/2012 | Maranto et al. | |
| 2012/0329320 | A1 | 12/2012 | Taylor et al. | |

FOREIGN PATENT DOCUMENTS

| | | |
|---|---|---|
| EP | 1 988 611 A1 | 5/2008 |

* cited by examiner

*Primary Examiner* — Tho D Ta
(74) *Attorney, Agent, or Firm* — Juneau & Mitchell

(57) ABSTRACT

A plug-in terminal for a data or telecommunication cable comprising terminal elements for connecting at least one electrical or optical conductor, further comprising connecting elements for connecting the electrical or optical conductor(s) with an electronic device, wherein the plug-in terminal comprises a storage for data and a means for reading out and/or archiving data in the storage by means of the electronic device, and a method of use thereof.

17 Claims, 9 Drawing Sheets

PLUG FOR A DATA AND/OR TELECOMMUNICATION CABLE COMPRISING SEVERAL CONDUCTORS

CROSS REFERENCE TO RELATED APPLICATIONS

This patent application claims priority German Patent Application 10 2013 207 234.1, filed on Apr. 22, 2013.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The invention relates to a plug for a data and/or telecommunication cable comprising several conductors.

2. Background of the Invention

The current state of knowledge is as follows.

Plugs for a data and/or telecommunication cable comprising several conductors, particularly RJ45 plugs, are available in a variety of embodiments. Due to the constant increase of the speed of transmission, the requirements for plugs are becoming increasingly higher. For higher transmission speeds, it is crucial that the wave resistance of the plug is as homogenous as possible and shows a defined, low interference between the individual conductors. Here, it is crucial that these features are also ensured on a large scale.

In order to ensure the defined, low interference, it is known to align the conductors in the plug in a defined relative arrangement in reference to each other. The insertion of the conductors into the plug and the fastening of these conductors in said plug generally occur by hand. In order to ensure a defined alignment of the conductors in reference to each other, plugs are known for a data and/or telecommunication cable comprising several conductors with a plug housing and a conductor guiding element, with the conductor guiding element comprising sockets for the conductors and which [conductor guiding element] can be inserted into the plug housing, and with contacts arranged in the plug housing for an electrically conductive connection to said conductors.

US 2012/0094525 A1 discloses a plug for a data and/or telecommunication cable with a plug housing and a conductor guiding element, with the conductor guiding element comprising through openings for the conductors in a first section, which are arranged parallel in reference to each other, but arranged at least in two different levels. The insertion of the conductors is time consuming. In the following area of the conductor guiding element no defined arrangement of the conductors is provided, which may lead to a worsening of the transmission characteristics.

EP 198 88 611 B1 discloses a plug for a data and/or telecommunication cable with a conductor guiding element, in which in a first section the conductors are arranged in one level running essentially parallel in reference to each other, and in an adjoining second section they are guided through channels in a defined fashion in reference to each other. The conductor guiding element is embodied in one piece and each conductor must be inserted individually into a respective channel, which is time consuming.

WO 2012/177486 A2 discloses a conductor guiding element for a plug for data and/or telecommunication cables with several socket channels in different levels in order to achieve a defined arrangement of the conductors in reference to each other. In this conductor guiding element the conductors also must be inserted individually into the channels, which is time consuming.

The objective of the invention is therefore to provide a plug for a data and/or telecommunication cable comprising several conductors with a plug housing and a conductor guiding element, with which a relatively easily manufactured and reproducible positioning of the conductors in reference to each other can be achieved in a plug, in order to particularly achieve a defined interference that is as low as possible.

Furthermore, the objective of the invention is to provide a method for connecting a cable to a plug which makes it possible to achieve a defined position of the conductors in reference to each other in a simple, reproducible fashion.

The objective is attained according to the invention via a plug for a data and/or telecommunication cable comprising several conductors with the features claimed herein and a method for connecting a cable to a plug with such features.

BRIEF SUMMARY OF THE INVENTION

In a preferred embodiment, a plug for a data and/or telecommunication cable comprising several conductors with a plug housing and a conductor guiding element, which comprises sockets for the conductors and which can be inserted into the plug housing, with contacts being arranged in the plug housing for the electrically conductive connection to the conductors, characterized in that the conductor guiding element comprises a first and a second element; that the sockets for the conductors are arranged in a conductor guiding element in a first section in one level and running essentially parallel in reference to each other; and that in a second section one of the elements comprises at least one projection and the other element comprises at least one recess, with the projection and the recess being arranged in reference to each other such that when the first and the second element are assembled the conductors in the second section can be transferred into at least two different levels.

In another preferred embodiment, the plug of as disclosed, wherein the first element and the second element are pivotal in reference to each other about a pivot axis.

In another preferred embodiment, the plug of as disclosed, wherein one of the elements comprises a recess into which a flap of the other element can be inserted.

In another preferred embodiment, the plug of as disclosed, characterized in that the flap is arranged pivotally at the other element.

In another preferred embodiment, the plug of as disclosed, wherein the flap is arranged at an angle in reference to the longitudinal axis of the other element.

In another preferred embodiment, the plug of as disclosed, wherein the sockets in the first section are arranged in one of the two elements as one or more through openings.

In another preferred embodiment, the plug of as disclosed, wherein the first element and the second element are connected to each other in one piece.

In another preferred embodiment, the plug of as disclosed, characterized in that the first element and the second element can be latched to each other after assembly via a latch connection.

In another preferred embodiment, the plug of as disclosed, characterized in that the first and the second element comprise a third section in which an essentially cylindrical interior chamber is formed by the first and the second element.

In another preferred embodiment, the plug of as disclosed, wherein the first element and/or the second element have one or more elevations on the inside, particularly in the third section, for example in the form of pyramids, cones, tips, or teeth.

The plug of claim 1, further comprising wherein a cable bushing made from an elastic material is arranged at the conductor guiding element.

In another preferred embodiment, the plug of as disclosed, further comprising wherein a groove is arranged at the conductor guiding element or the cable bushing engaged by a collar arranged at the cable bushing or the conductor guiding element.

In another preferred embodiment, the plug of as disclosed, further comprising wherein a cable bushing comprises a stop lever guard, which overlaps a free end of a stop lever arranged at the plug housing.

In a preferred embodiment, a method for connecting a cable to a plug, comprising the following steps:

a) removal of the cable jacket over a defined length starting at a free end of the cable, b) arrangement of the free ends of the conductors in one level parallel in reference to each other, c) insertion of the free ends of the conductors into a first section of a conductor guiding element of the plug, comprising a first element and a second element, with the conductors being arranged in the first section in one level parallel in reference to each other, d) assembly of the first element and the second element of the conductor guiding element, with the conductors being transferred into two different levels in a second section of the conductor guiding element, and e) insertion of the conductor guiding element into the plug housing.

In another preferred embodiment, the method of as disclosed, further comprising step f) the contacts are pressed into the conductors.

In another preferred embodiment, the method as disclosed, wherein the end of the cable to be connected is inserted into the conductor guiding element until the cable jacket contacts a stop at the conductor guiding element, and subsequently the conductors projecting from the conductor guiding element at the contact side are cut off.

In another preferred embodiment, the method as disclosed, characterized in that prior to removing the cable jacket a cable bushing is pushed onto the cable, which is pushed prior to the assembly of the first element and the second element of the conductor guiding element to such an extent towards the conductor guiding element that upon the assembly of the first element and the second element the first element and the second element encompass the cable bushing.

DETAILED DESCRIPTION OF THE INVENTION

Figure 1:
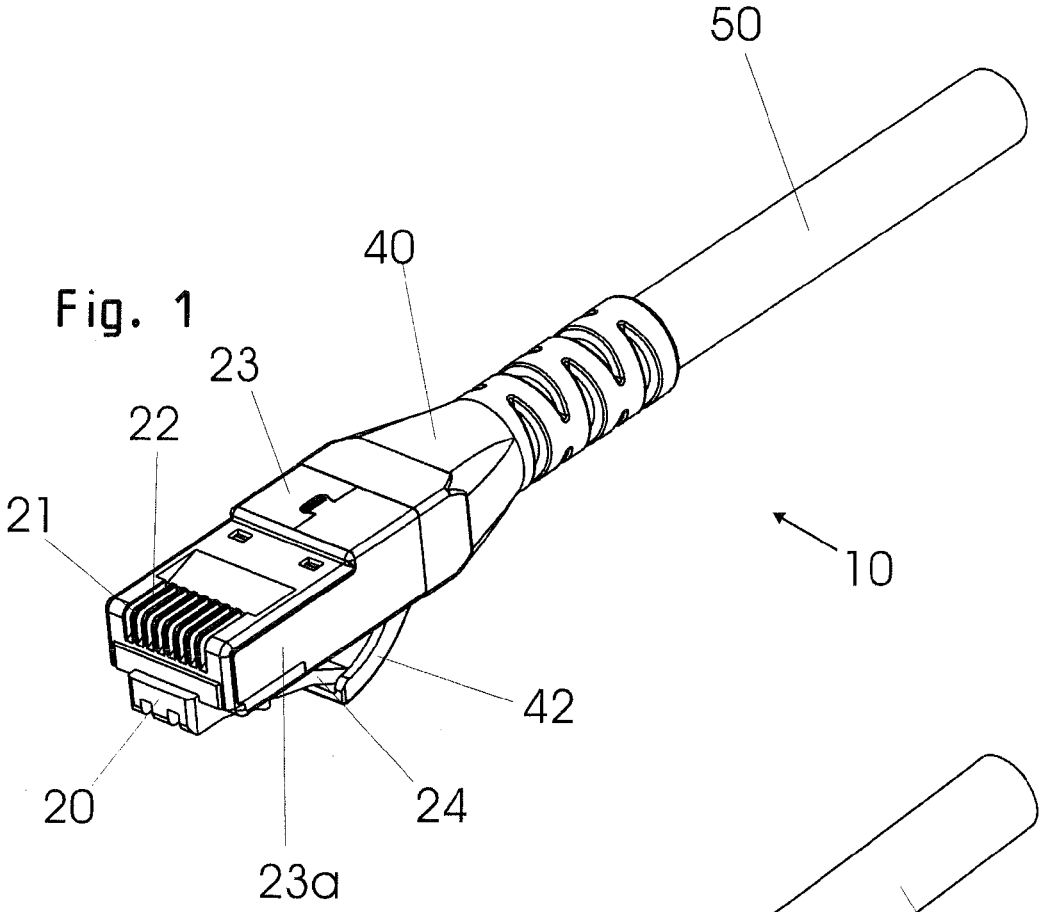
FIG. 1 is a line drawing evidencing a perspective view, diagonally from the bottom, of an exemplary embodiment of a plug according to the invention with a connected data and/or telecommunication cable.
Figure 2:
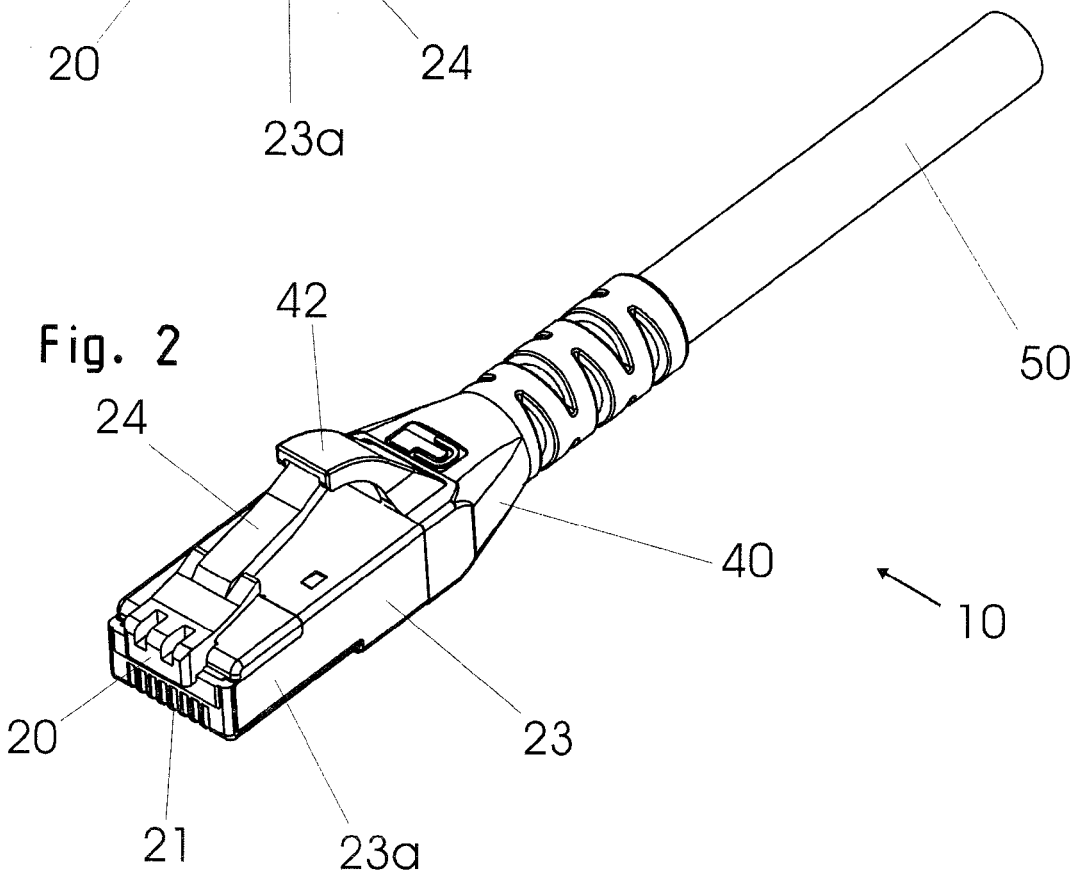
FIG. 2 is a line drawing evidencing a perspective view, diagonally from the top, of a plug with a cable according to FIG. 1.
Figures 3, 4:
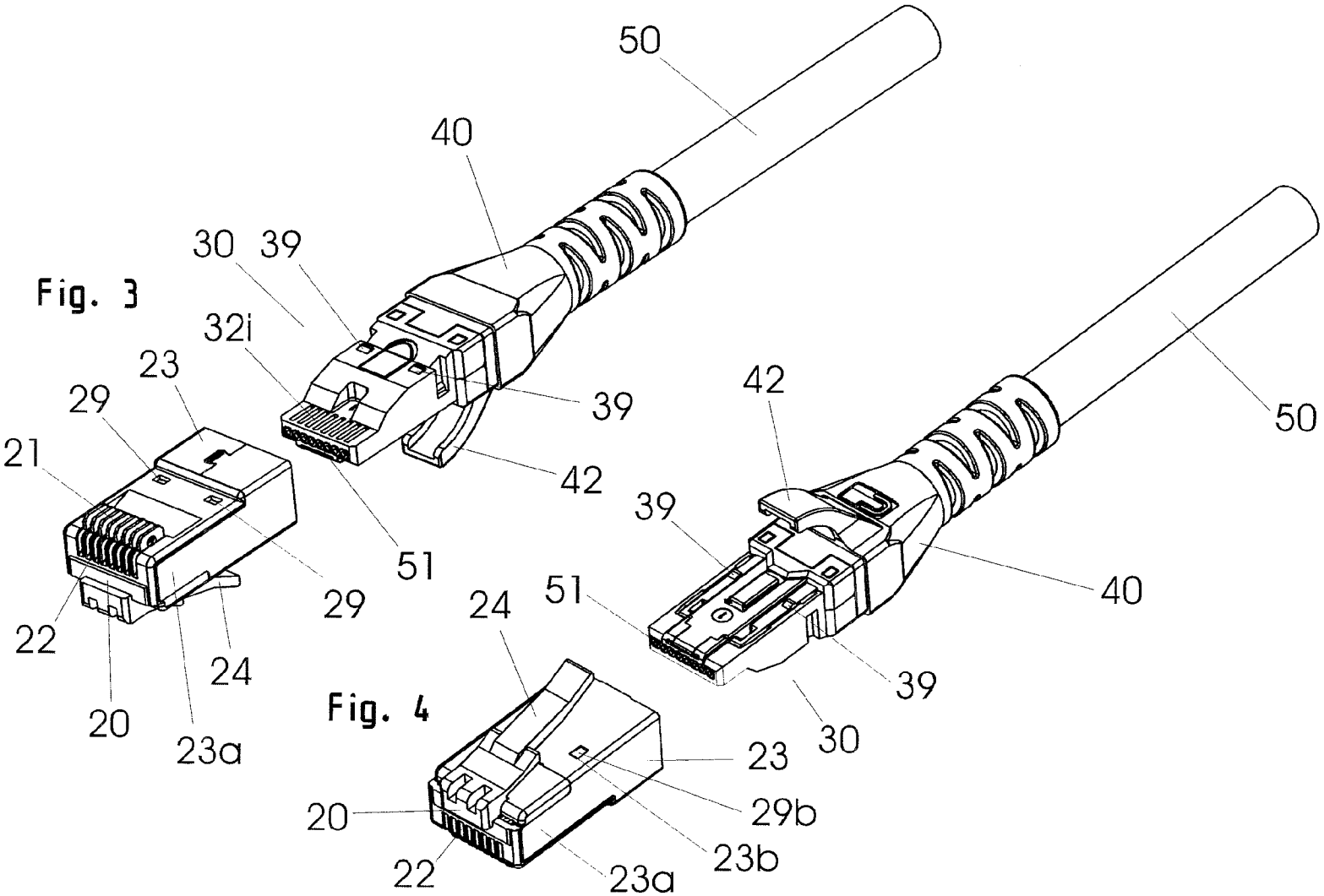
FIG. 3 is a line drawing evidencing a perspective view, diagonally from the bottom, of the plug according to FIG. 1, with the plug housing removed and a view of the conductor guiding element.
FIG. 4 is a line drawing evidencing a perspective illustration, diagonally from the top, of the plug according to FIG. 3.
Figure 5:
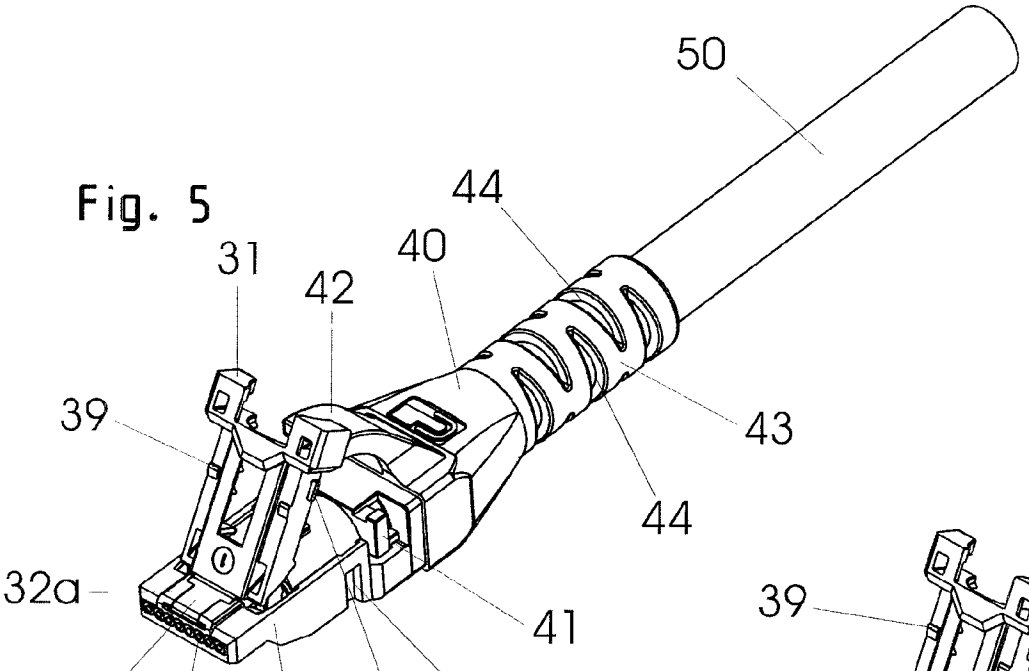
FIG. 5 is a line drawing evidencing the conductor guiding element of the plug according to FIGS. 1 through 4 with a connected cable and a cable bushing.
Figure 6:
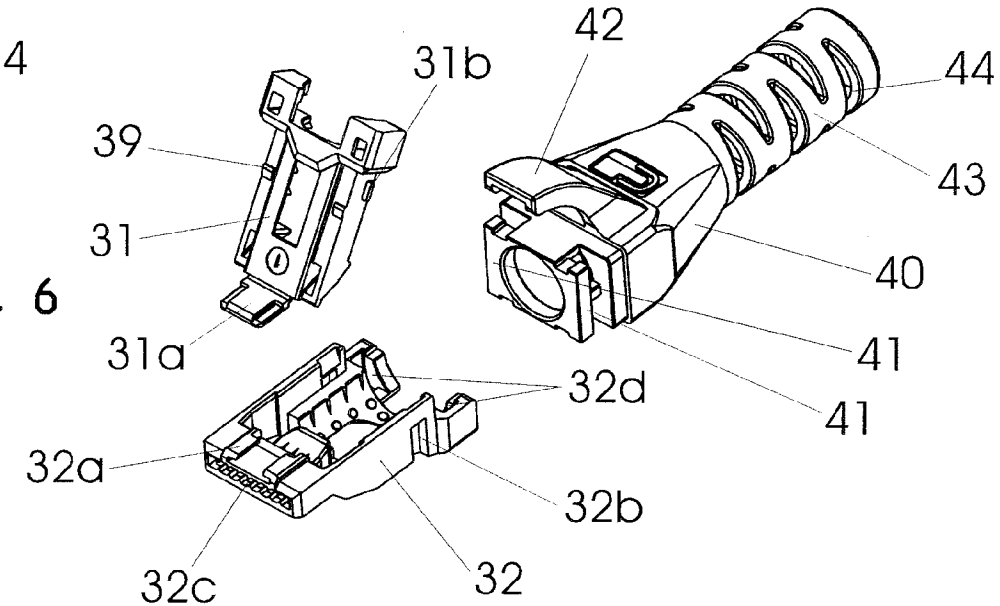
FIG. 6 is a line drawing evidencing an exploded illustration of the conductor guiding element with a cable bushing.

The plug according to the invention for a data and/or telecommunication cable comprising several conductors with a plug housing and a conductor guiding element, which comprises sockets for the conductors and which can be inserted into the plug housing, with contacts being arranged in the plug housing for an electrically conductive connection to the conductors, is characterized in that the conductor guiding element comprises a first and a second element; that in a first section the sockets for the conductors are arranged in one level in the conductor guiding element, essentially running parallel in reference to each other; and that in a second section one of the elements comprises at least one projection and the other element at least one recess, with the projection and the recess being arranged in reference to each other such that upon the assembly of the first and the second element the conductors of the second section can be transferred into at least two different levels, i.e. particularly that at least one of the conductors is arranged in one level, and at least one other conductor comes to rest in a level different from that level, which is particularly arranged parallel in reference to the first level. This way, after the assembly the conductors are arranged in at least two different levels. One of these levels may coincide with the level in which the conductors are arranged in the first section. However, this is not mandatory. The embodiment of the conductor guiding element according to the invention facilitates that the conductors can be easily inserted into the conductor guiding element, because in one level only the free ends of the conductors need to be aligned running parallel in reference to each other, which can easily be achieved by hand; subsequently, the free ends can all be inserted jointly into the first section of the transfer element, and the defined relative alignment of the conductors in a second section in reference to each other is achieved here automatically when the first and the second element are assembled, without the user being required to insert the conductors individually into the various sockets. This leads to significant time savings during the assembly of the cable to the plug.

Advantageously, the first element and the second element can be pivoted in reference to each other about a pivot axis. This way a relative alignment is already determined in one spatial direction between the first element and the second element, and the assembly of the first element and the second element is simplified.

A preferred embodiment provides for one of the elements to comprise a recess, in which a flap of the other element can be inserted. Such a construction facilitates a simple assembly of the conductor guiding element from two elements.

It is particularly preferred that the flap is arranged pivotally at the other element, thus facilitating, after the assembly of the conductor guiding element from two elements, the transfer of the conductors in the second section into various levels only during the assembly of these two elements.

According to a particularly preferred embodiment, the flap is arranged at an angle in reference to the longitudinal axis of the other element. This facilitates that, after the assembly of the conductor guiding element by inserting the flap into the recess, the element at which the flap is arranged but not yet assembled to the other element remains open, such that the conductors can easily be inserted into the conductor guiding element before the two elements are assembled. Furthermore, this facilitates that the assembly of the two parts can occur only after the insertion of the conductors in a particularly simple fashion.

Preferably, the sockets in the first section are arranged as one or multiple through bores in one of the two elements. This particularly facilitates that the conductors cannot slip out of the sockets in the first section perpendicular in reference to the longitudinal direction of the sockets, and thus an easily manufactured and reproducible positioning of the conductors in reference to each other is made possible.

According to a preferred embodiment of the invention, the first element and the second element are connected to each other in one piece, for example by means of an integral hinge. This way the number of components is reduced.

A particularly preferred embodiment of the invention provides that the first element and the second element latch to each other after assembly via a latching connection in order to reliably secure the conductors in the conductor guiding element and prevent an accidental opening of the conductor guiding element.

Advantageously, the first and the second element show a third section in which an essentially cylindrical interior chamber is formed by the first and the second element. Usually the coating of the data and/or telecommunication cable ends in this section, which therefore can be inserted into the plug housing and can be secured reliably inside the plug, particularly inside the conductor guiding element.

A particularly preferred embodiment of the invention provides for the first element and/or the second element to show one or more elevations, for example in the form of pyramids, cones, tips, or teeth on its inside, particularly in a third section. Such elevations dig or bore into the jacket of the data and/or telecommunication cable during the assembly of the first and the second element in order to counteract any pull on the data and/or telecommunication cable with high resistance.

According to a preferred embodiment of the invention, a cable bushing made from an elastic material for tension relief and/or to prevent bending is arranged at the conductor guiding element.

Preferably, a groove is arranged at the conductor guiding element or the cable bushing, engaged by a collar arranged at the cable bushing or the conductor guiding element. This way, in an easily designed embodiment, a fixation can be achieved in the axial direction of the cable bushing.

Advantageously, the cable bushing comprises a stop lever guard, which overlaps a free end of a stop lever arranged at the plug housing.

The method according to the invention for connecting a cable to a plug comprises the following steps: starting at a free end of the cable, the cable coating is removed over a defined length. The free ends of the conductors are arranged parallel in reference to each other in one level, which can easily be achieved for example by compressing two fingers of one hand of a user. The free ends of the conductors are inserted into a first section of the conductor guiding element of the plug, which comprises a first element and a second element and with the conductors being arranged in the first section in one level parallel in reference to each other. Here, it is particularly possible to simultaneously insert all free ends of the conductors, because the conductors are arranged in the first section in one level and parallel in reference to each other. The first element and the second element of the conductor guiding element are assembled, with the conductors in a second section of the conductor guiding element being transferred into two different levels. Subsequently, the conductor guiding element is inserted into the plug housing. This method saves a lot of time compared to conventional methods for connecting a cable to a plug because all free ends of the conductors can be simultaneously inserted into the conductor guiding element, and it is no longer necessary to insert individual conductors successively into the individual sockets. Additionally, the defined relative arrangement of the conductors to each other in the second section is effectively automatically achieved by assembling the first element and the second element, without the user being required to take action for this.

Preferably, after the insertion of the conductor guiding element into the plug housing, the contacts are pressed into the conductors in order to establish the electrically conductive connection between the contacts and the conductors. For this purpose it is particularly preferred that the contacts are embodied as piercing contacts.

A particularly advantageous embodiment of the invention provides that the connecting end of the cable is inserted into the conductor guiding element until the cable jacket hits to a stop at the conductor guiding element and, subsequently, the conductors projecting at the contact side from the conductor guiding element are cut off. This ensures that the insulation of the cable reaches into the plug housing and all conductors completely cross through the conductor guiding element.

According to an advantageous further development of the invention, prior to removing the cable jacket, a cable bushing is pushed onto the cable, which, before the first element and the second element of the conductor guiding element (30) are assembled, is pushed towards the conductor guiding element to such an extent that during the assembly of the first element and the second element, the first element and the second element encompass the cable bushing in order to allow a fixation of the cable bushing.

DETAILED DESCRIPTION OF THE FIGURES

FIGS. 1 through 4 show various illustrations of a plug 10 for a data and/or telecommunication cable 50, comprising several conductors 51, which comprises a plug housing 20, a conductor guiding element 30, and a cable bushing 40.

Figure 13A:
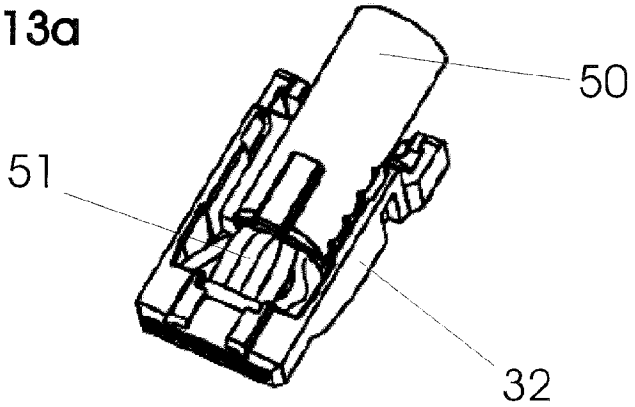
FIG. 13*a* is a line drawing evidencing the cable with the first element of the conductor guiding element according to FIG. 12*a* after the second element of the conductor guiding element has been assembled to the first element of the conductor guiding element, with the second element of the conductor guiding element not being shown for a better overview.
Figure 13B:
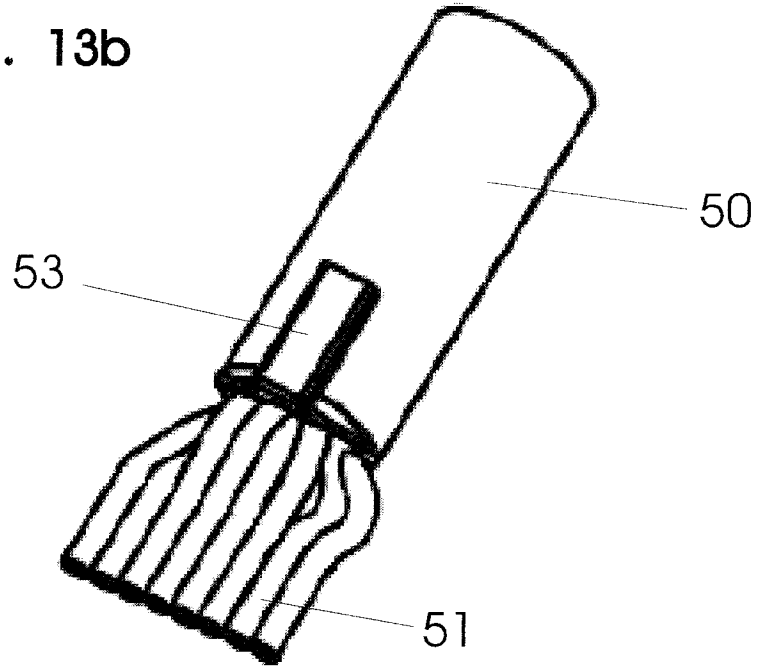
FIG. 13*b* is a line drawing evidencing the cable of the arrangement according to FIG. 13*a* without the conductor guiding element.

The cable 50 particularly comprises eight conductors 51, which are arranged in four pairs of two conductors 51 each, twisted with each other. In order to be able to connect the cable 50 to the plug 10, the cable jacket 52 insulating the conductors 51 is removed over a desired length. The conductors 51 are generally surrounded by a cable shield 53, which is also removed from the conductors 51 over a desired length, and for example is twisted to a tongue in order to allow the connection of the cable shield 53 to a shield of the plug 10 (cf. FIG. 13*b*).

The conductor guiding element 30 comprises a first element 31 and a second element 32, which can be assembled after the conductors 51 have been inserted. When assembling the first element 31 and the second element 32 the conductors 51 can be clamped together, particularly in the conductor guiding element 30.

Figure 7A:
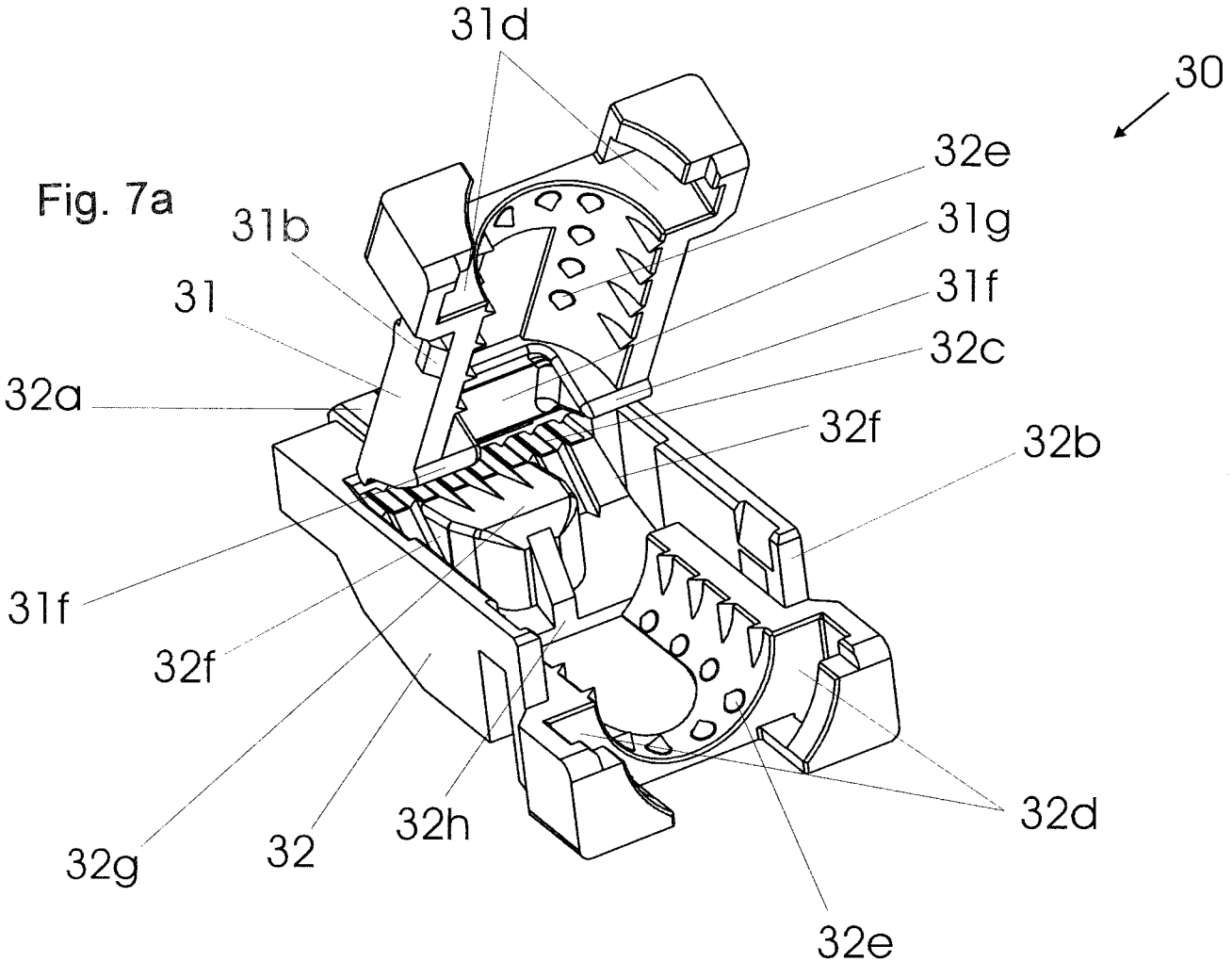
FIG. 7*a* is a line drawing evidencing a perspective view of the conductor guiding element of the plug according to FIGS. 1 through 4.
Figure 7B:
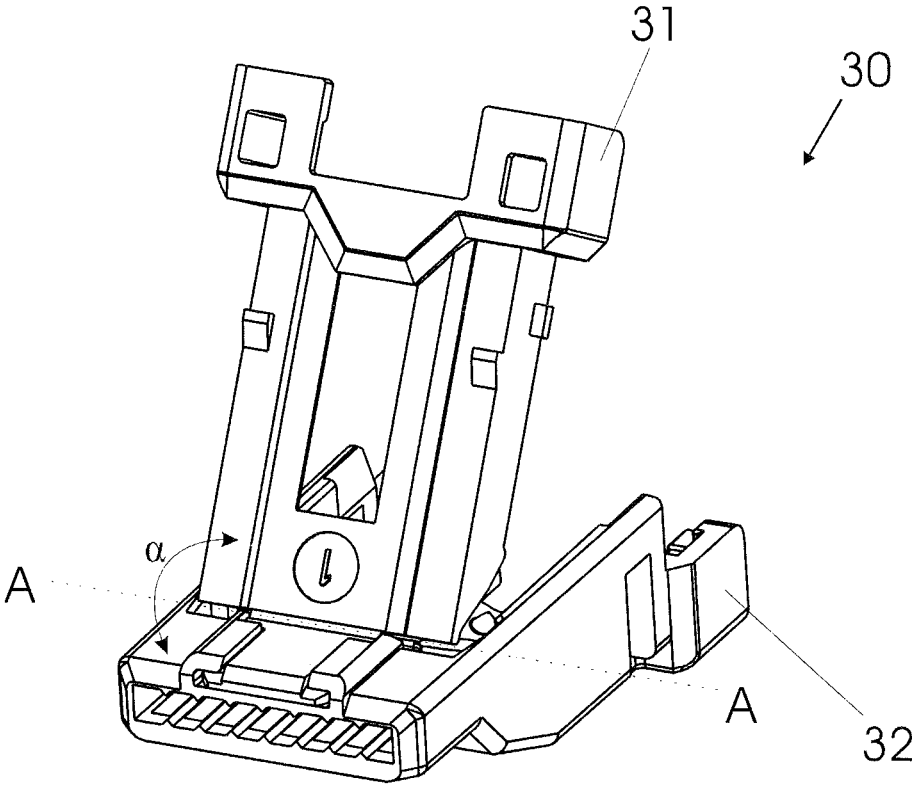
FIG. 7*b* is a line drawing evidencing another perspective view of the conductor guiding element of the plug according to FIGS. 1 through 4.
Figure 8:
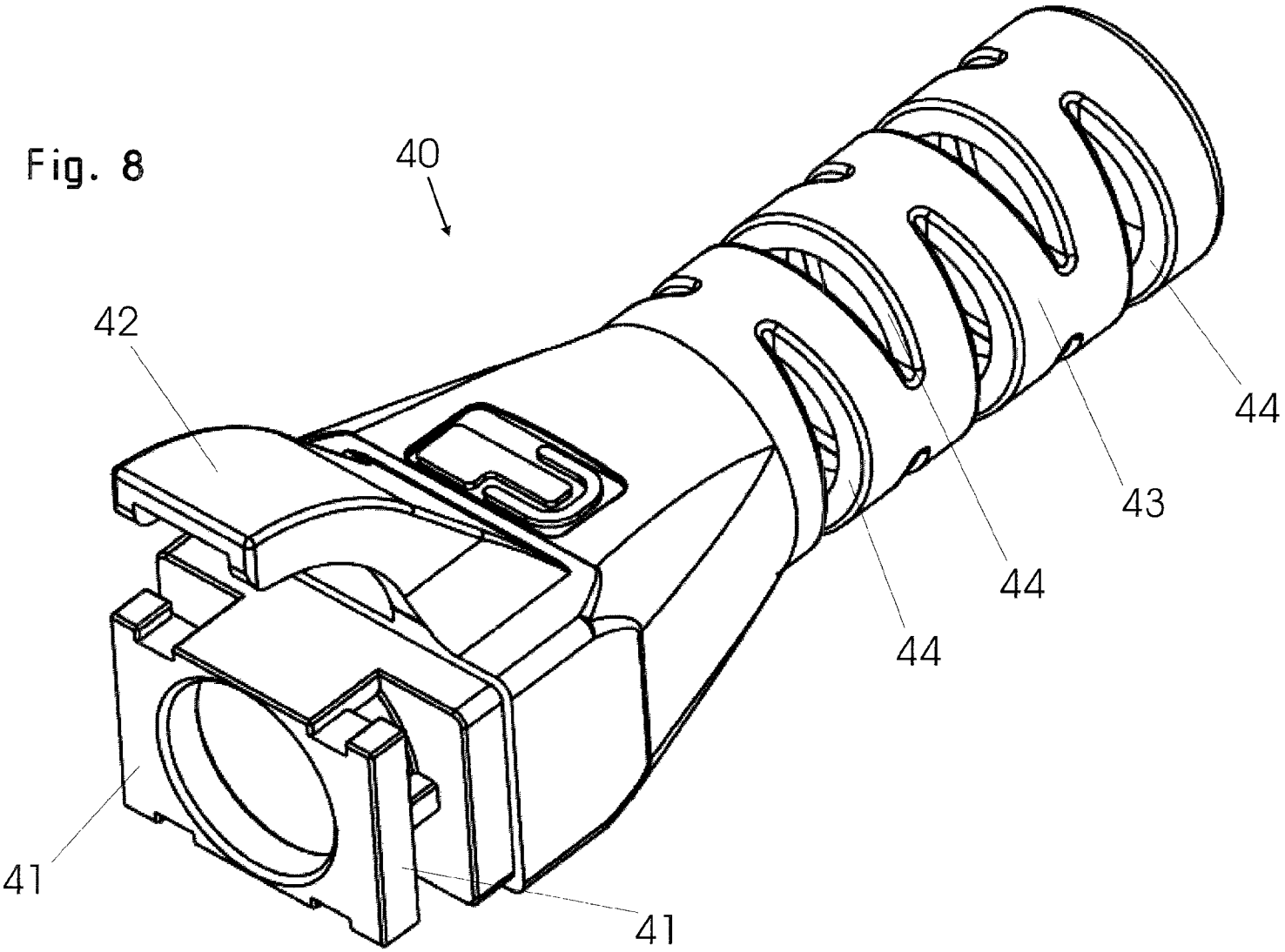
FIG. 8 is a line drawing evidencing a perspective illustration of the cable bushing of the plug according to FIGS. 1 through 4.
Figure 9:
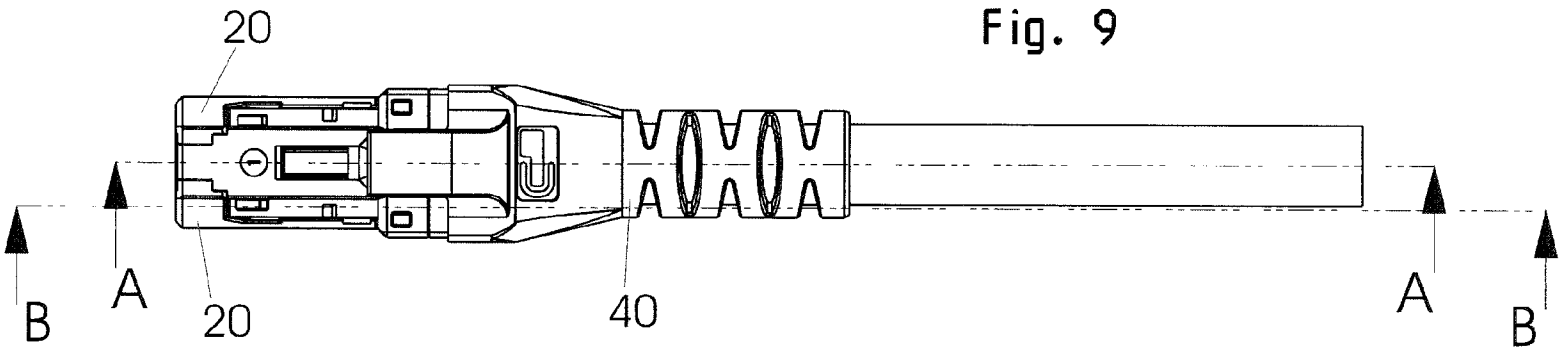
FIG. 9 is a line drawing evidencing a top view of the conductor guiding element with a connected cable and cable bushing.

In one embodiment, the first element 31 and the second element 32 are arranged pivotally about a pivot axis A in reference to each other (cf. FIG. 7*b*). It is possible to connect the first element 31 and the second element 32 to each other in one piece, for example via an integral hinge. In the embodiment shown in the figures, the first element 31 shows a flap 31*a*, which can be inserted into a socket 32*a* of the second element 32 in order to establish a connection between the first element 31 and the second element 32. The flap 31*a* is pivotal, particularly about a pivot axis A, so that the first element 31 can be pivoted towards the second element 32. In one embodiment, the flap 31*a* is tilted at an angle $\alpha$ in reference to a longitudinal axis of the first element 31 (cf. FIG. 7*b*) so that the first element 31, after the flap 31*a* has been inserted into the socket 32*a* of the second element 32, projects such that access is facilitated to the interior chamber of the conductor guiding element 30 between the first element 31 and the second element 32.

After pivoting the first element 31 towards the second element 32, the two elements 31, 32 can mutually latch to each other via a latching connection. For this purpose a latch cam 31*b* is arranged at the first element 31, which engages a corresponding latch opening 32*b* arranged at the second element 32.

The conductor guiding element 30 comprises a first section 30*a*, in which the conductors 51 are arranged in one level and are essentially running parallel in reference to each other; a second section 30*b*, in which the conductors 51 are arranged in at least two different levels and are essentially running parallel in reference to each other; and a third section 30*c*, in which the conductors 51 are transferred from the arrangement of the second section 30*b* into an arrangement in which the cables 50 are twisted with each other in pairs.

In the first section 30*a* of the conductor guiding element 30, the second element 32 comprises one or more sockets for the conductors 51, embodied as through openings 32*c*. It is possible to provide several through openings 32*c*, particularly one for each of the conductors 51. The sockets are designed such that the conductors 51 arranged in them are all arranged in the first section 30*a* in one level and aligned parallel in reference to each other. Due to the frequently very limited construction space, the through openings 32*c* for the various conductors 51 are generally located in reference to each other in such proximity that the separating walls between the individual through openings are omitted and the through openings for the various conductors 51 merge to form a single through opening 32*c*, which however preferably shows longitudinal grooves at the top and the bottom for accepting the conductors 51. Through this embodiment of the through opening 32*c*, a defined, relative arrangement of the conductors 51 in reference to each other in a first section 30*a* within minimum space is made possible.

In the first section 30*a*, the electric contacting of the conductors 51 in particular occurs. For this purpose, slots 32*i* are arranged perpendicular in reference to the longitudinal direction of the conductors 51, particularly with their number coinciding with the number of conductors 51. In the exemplary embodiment shown, the slots 32*i* are arranged starting from the exterior surface of the second elements 32 to one or more through openings 32*c*.

In one embodiment, the socket 32*a* of the second element 32 is arranged in the first section 30*a* at the second element 32.

Figure 12A:
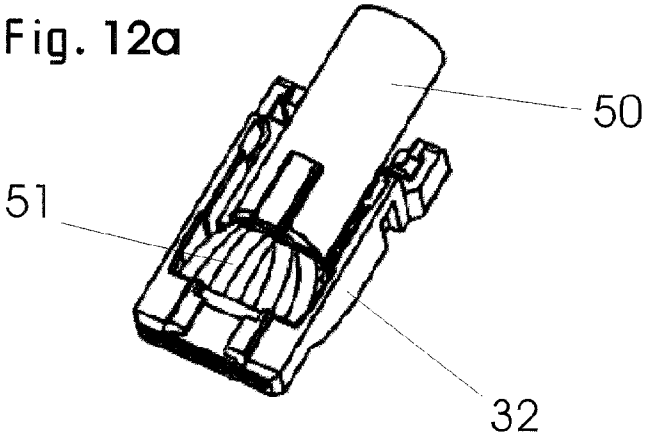
FIG. 12*a* is a line drawing evidencing the first element of the conductor guiding element according to FIG. 7 with an inserted cable.
Figure 12B:
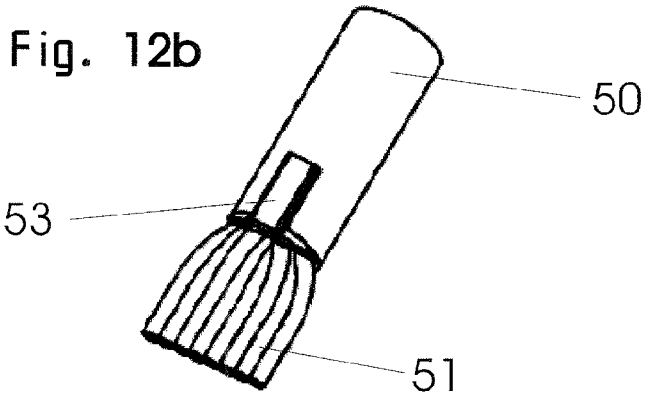
FIG. 12*b* is a line drawing evidencing the cable according to FIG. 12*a* without the first element of the conductor guiding element.

When the free ends of the conductors 51 of the cable 50 are inserted into the conductor guiding element 30, the exposed conductors 51 are first manually aligned parallel in reference to each other in one level, and their free ends are subsequently inserted into the through openings 32*c* of the second element 32, as shown in FIG. 12*a*. The cable 50 is shown in this position without the second element 32 in FIG. 12*b*.

Figure 10:
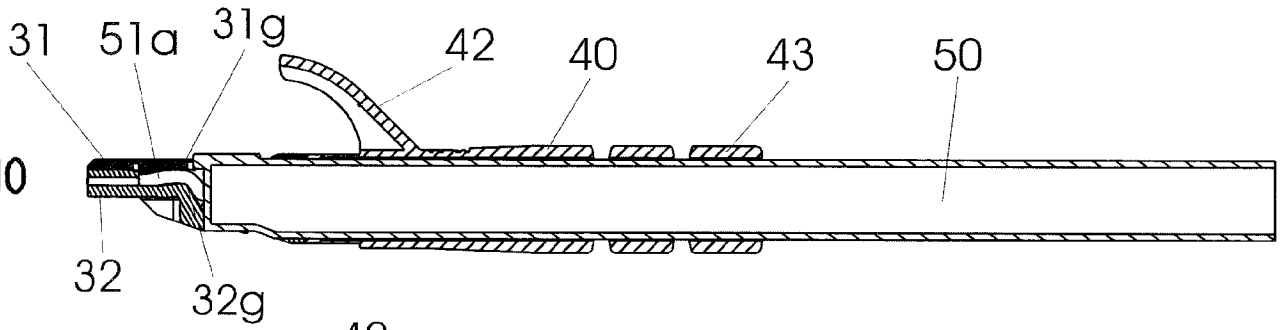
FIG. 10 is a line drawing evidencing a cross-section along the line A-A in FIG. 9.
Figure 11:
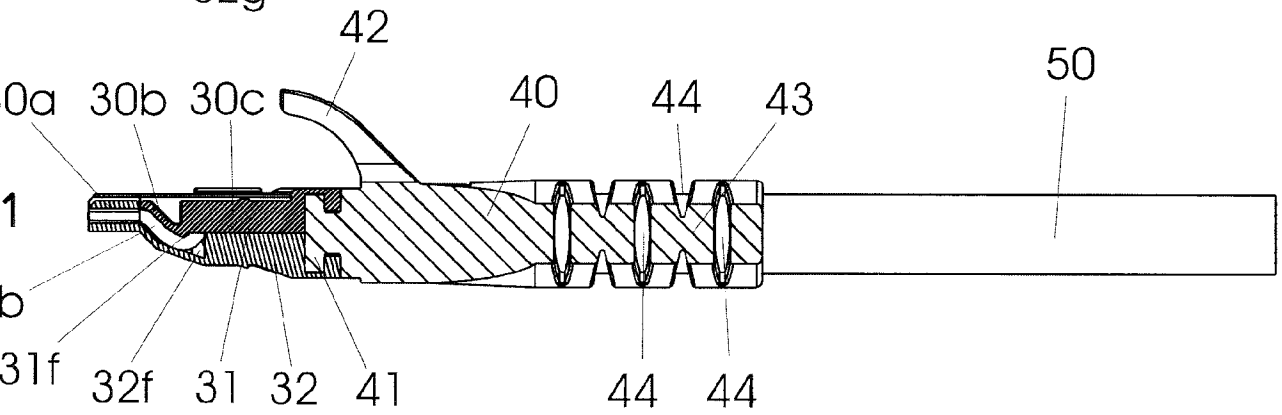
FIG. 11 is a line drawing evidencing a cross-section along the line B in FIG. 9.

In the second section 30*b*, one of the elements 31, 32 has at least one projection 31*f*, 32*f* and the other element 32, 31 at least one recess 32*f*, 31*g*, which are arranged in reference to each other such that upon the assembly of the first element 31 and the second element 32 the conductors 51 can be transferred into at least two different levels in the second section 30*b*. As discernible from FIG. 7, the second element 32 comprises a projection 32*g*, which engages a recess 31*g* arranged in the first element 31 when the first element 31 is pivoted towards the second element 32 and the two elements 31, 32 are assembled. Two projections 31*f* are arranged laterally in reference to the recess 31*g* provided in the first element 31, which engage recesses 32*f* arranged in the second element 32 laterally in reference to the projection 32*g* when assembling the first element 31 and the second element 32. Via the projections 31*g*, 32*g* the conductors 51 guided through the second section 30*b* are pressed into the corresponding recesses 32*f*, 31*g* when the elements 31, 32 are assembled and thus come to rest in two different levels. This is particularly discernible in FIGS. 10 and 11, which show two parallel, longitudinal cross-sections—arranged offset—through a completely assembled plug 10. FIG. 10 shows a cross-section in the longitudinal direction of the plug 10 through the projection 32*g* of the second element and the recess 31*g* of the first element. Compared to the level in which the conductors 51 are arranged in the first section 30*a*, at least one conductor 51*a* is deflected by the projection 32*g* in the direction towards the exterior of the first element 31. FIG. 11 shows a cross-section arranged parallel in reference to the cross-section according to FIG. 10 through the projection 31*f* of the first element and the corresponding recess 32*f* of the second element. Compared to the level in which the conductors 51 are arranged in the first section 30*a*, at least one conductor 51*b* is deflected in the direction towards the exterior of the second element 32, such that overall a space is arranged between two different conductors 51*a*, 51*b* in the second section 30*b* of the conductor guiding element 30 in a direction perpendicular in reference to the level, in which all conductors 51 are arranged in the first section 30*a*. This way, a defined relative arrangement of the conductors 51 is yielded in the second section 30*b* when the elements 31, 32 are assembled without the conductors 51 needing to be inserted individually into different sockets.

In the third section 30*c*, the first element 31 and the second element 32 form an essentially cylindrical interior chamber in which the conductors 51 can be transferred from the arrangement of the second section 30*b* into the arrangement in the cable 50, in which they are twisted together in pairs. Advantageously, the cable jacket 52 of the cable 50 ends in the third section 30*c*, such that the insulation of the cable 50 is guided into the plug 10. On the inside of the third section 30*c*, the first element 31 and the second element 32 show several elevations 31*e*, 32*e*, which may be embodied in the form of tips, cones, pyramids, or teeth, engaging the cable jacket 52 of the cable 50 when the elements 31, 32 are assembled and fixating said jacket in the axial direction.

The cable bushing 40 may show a circumferential sleeve 41, which upon the assembly of the elements 31, 32 comes to rest in a groove 31*d*, 32*d* arranged in the elements 31, 32. This way, the connection between the conductor guiding element 30 and the cable bushing 40 is established, allowing particularly for fixation of the cable bushing 40 in the axial direction.

Advantageously, in order to connect the cable 50 to the plug 10 and particularly to the conductor guiding element 30, the cable 50 is first guided through the cable bushing 40 and then the free ends of the conductors 51 are arranged in the conductor guiding element 30.

In one embodiment, the cable bushing 40 comprises a stop lever guard 42, which overlaps a stop lever 24 arranged at the plug housing 20 and protects against damage. The stop lever 24 serves for latching the plug 10 to a corresponding socket. The cable bushing 40 is preferably produced from an elastic material. Further, in one embodiment the cable bushing 40 comprises a bend protector 43, which is embodied as an essentially cylindrical section contacting the cable jacket 52 of the cable 50 and with several slots 44, running over a section in the circumferential direction, which particularly prevent any breaking of the cable 50 and only allow the bending of the cable 50 within a desired radius.

After the conductors have been inserted into the conductor guiding element 30 and the elements 31, 32 have been assembled, with the conductors 51 being fixed in the conductor guiding element 30 and the cable bushing 40 being fixed at the conductor guiding element 30, the conductor guiding element 30 can be inserted into the plug housing 20. The conductor guiding element 30 comprises one or more latch cams 39, which engage latch openings 29 arranged at the plug housing 20. Here, the first section 30*a* of the conductor guiding element 30 here comes to rest at the contact side in an end of the plug housing 20, in which several openings 22 are arranged, in which one contact 21 each is arranged, which is embodied for example as a piercing contact. After the conductor guiding element 30 has been inserted into the plug housing 20, the contacts 21 can be pushed through the openings 22 in order to contact the conductors 51 in the first section 30*a* arranged in the conductor guiding element 30.

In one embodiment, the plug housing 20 comprises a shield 23, which is to be connected to the cable shield 23 of the cable 50. For this purpose, the cable shield 53, twisted into a tongue, contacts the shield 23 of the plug housing 20. Here, the shield 23 contacts the cable shield 53 of the cable 50, for example via an opening in the top of the plug housing 20. The shield 23 can latch with the plug housing 20 via a latch opening 23*b*, for example at a latch cam 29*b*. The shield 23 can have a shield contacting tongue 23*a*, which contacts a shield arranged in the socket when the plug 10 is inserted into a corresponding socket.

In order to assemble the plug 10, first the cable bushing 40 is pushed over the cable 50. Starting at the free end of the cable 50, the cable jacket 52 is removed over a desired length, any potentially present cable shield 53 is twisted into a tongue and shortened, and any potentially present pair-shield is removed. Subsequently, the conductors 51 are sorted into the desired sequence and arranged in one level, for example by two fingers of the hand of a person pressing them. The conductors 51 aligned in this fashion are inserted into the through opening 32*c* of the second element 32, preferably until the cable jacket 52 contacts a stop 32*h* of the conductor guiding element 30, which may be arranged for example in the transfer section between the second section 30*b* and the third section 30*c* of the conductor guiding element 30. The resulting arrangement of the conductors 51 is particularly discernible from FIGS. 12*a* and 12*b*. Subsequently, the cable bushing 40 can be pushed towards the conductor guiding element 30 to such an extent that the collar 41 of the cable bushing 40 can be inserted into the groove 32*d* of the second element 32. Then, the two elements 31, 32 are brought together until the latch cam 31*b* of the first element 31 latches with the latch opening 32*b* of the second element 32. Here, the collar 31 engages the groove 31*d* of the first element 31. Furthermore, during the assembly of the elements 31, 32 the conductors 51 are pushed through the projections 31*f*, 32*g* into the corresponding recesses 31*g*, 32*f* and aligned as desired. The geometry of the arrangement of the conductors 51 is particularly discernible from FIGS. 13*a* and 13*b*. The conductors 51 projecting from the conductor guiding element 30 at the contact side are cut off, particularly after ensuring that all conductors 51 project from the front of the conductor guiding element 30. Then, the conductor guiding element 30 can be inserted into the plug housing 20 and latch there via the latch connections 29, 39. Subsequently, the contacts 21 can be pressed through the openings 22 of the plug housing 20 and through the slots 32*i* of the conductor guiding element 30 into the conductors 51 in order to contact the electric conductors of the lines 51.

LIST OF REFERENCE NUMBERS

10 Plug
20 Plug housing
21 Contact
22 Opening
23 Shield
23*a* Shield contact
23*b* Latch opening
24 Stop lever
29 Latch opening
29*b* Latch cam
30 Conductor guiding element
30*a* First section
30*b* Second section
30*c* Third section
31 First element
31*a* Flap
31*b* Latch cam
31*d* Groove
31*e* Elevation
31*f* Projection
31*g* Recess

32 Second element
32*a* Socket
32*b* Latch opening
32*c* Through opening
32*d* Groove
32*e* Elevation
32*f* Recess
32*g* Projection
32*h* Stop
32*i* Slot
39 Latch cam
40 Cable bushing
41 Collar
42 Stop lever guard
43 Bend protector
44 Slot
50 Cable
51 Conductor
51*a* Conductor
51*b* Conductor
52 Cable jacket
53 Cable shield
A Pivot axis
α Angle The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A plug for a data and/or telecommunication cable comprising several conductors with a plug housing and a conductor guiding element, which comprises sockets for the conductors and which can be inserted into the plug housing, with contacts being arranged in the plug housing for the electrically conductive connection to the conductors, wherein the conductor guiding element comprises a first and a second element; that the sockets for the conductors are arranged in a conductor guiding element in a first section in one level and running essentially parallel in reference to each other; and that in a second section one of the elements comprises at least one projection and the other element comprises at least one recess, with the projection and the recess being arranged in reference to each other such that when the first and the second element are assembled, such projection and recess transfer the conductors in the second section into at least two different levels.

2. The plug of claim 1, wherein the first element and the second element are pivotal in reference to each other about a pivot axis.

3. The plug of claim 1, wherein one of the elements comprises a recess into which a flap of the other element can be inserted.

4. The plug of claim 3, wherein the flap is arranged pivotally at the other element.

5. The plug of claim 3, wherein the flap is arranged at an angle in reference to the longitudinal axis of the other element.

6. The plug of claim 1, wherein the sockets in the first section are arranged in one of the two elements as one or more through openings.

7. The plug of claim 1, wherein the first element and the second element are connected to each other in one piece.

8. The plug of claim 1, wherein the first element and the second element can be latched to each other after assembly via a latch connection.

9. The plug of claim 1, wherein the first and the second element comprise a third section in which an essentially cylindrical interior chamber is formed by the first and the second element.

10. The plug of claim 1, wherein the first element and/or the second element have one or more elevations on the inside, particularly in the third section, for example in the form of pyramids, cones, tips, or teeth.

11. The plug of claim 1, further comprising wherein a cable bushing made from an elastic material is arranged at the conductor guiding element.

12. The plug of claim 1, further comprising wherein a groove is arranged at the conductor guiding element or the cable bushing engaged by a collar arranged at the cable bushing or the conductor guiding element.

13. The plug of claim 1, further comprising wherein a cable bushing comprises a stop lever guard, which overlaps a free end of a stop lever arranged at the plug housing.

14. A method for connecting a cable to a plug, comprising the following steps:

a) removal of the cable jacket over a defined length starting at a free end of the cable, b) arrangement of the free ends of the conductors in one level parallel in reference to each other, c) insertion of the free ends of the conductors into a first section of a conductor guiding element of the plug, comprising a first element and a second element, with the conductors being arranged in the first section in one level parallel in reference to each other, d) assembly of the first element and the second element of the conductor guiding element, with the conductors being transferred into two different levels in a second section of the conductor guiding element by at least one recess and at least one projection integrated within the assembled conductor guiding element, and e) insertion of the conductor guiding element into a plug housing.

15. The method of claim 14, further comprising step:

f) the contacts are pressed into the conductors.

16. The method of claim 14, wherein the end of the cable to be connected is inserted into the conductor guiding element until the cable jacket contacts a stop at the conductor guiding element, and subsequently the conductors projecting from the conductor guiding element at the contact side are cut off.

17. The method of claim 14, wherein, prior to removing the cable jacket a cable bushing is pushed onto the cable, which is pushed prior to the assembly of the first element and the second element of the conductor guiding element to such an extent towards the conductor guiding element that upon the assembly of the first element and the second element the first element and the second element encompass the cable bushing.

* * * * *